United States Patent [19]

Fink et al.

[11] Patent Number: 4,610,228

[45] Date of Patent: Sep. 9, 1986

[54] CRANKCASE ASSEMBLY FOR AN ENGINE OF A PORTABLE TOOL

[75] Inventors: Reinhold Fink, Fellbach; Michael Leuchte, Stuttgart, both of Fed. Rep. of Germany

[73] Assignee: Andreas Stihl, Waiblingen, Fed. Rep. of Germany

[21] Appl. No.: 762,108

[22] Filed: Aug. 2, 1985

[30] Foreign Application Priority Data

Aug. 21, 1984 [DE] Fed. Rep. of Germany ..... 3430645

[51] Int. Cl.[4] ..... F02F 7/00

[52] U.S. Cl. ..... 123/195 R; 123/195 C; 92/169

[58] Field of Search ..... 92/169, 261; 123/195 C, 123/197 R, 195 R

[56] References Cited

U.S. PATENT DOCUMENTS 4,434,756 3/1984 Nilsson et al. ..... 123/195 R

*Primary Examiner*—Carroll B. Dority, Jr.

*Attorney, Agent, or Firm*—Walter Ottesen

[57] ABSTRACT

A crankcase assembly for the engine of a portable tool such as chain saw or the like is disclosed. A plastic crankcase is connected to the cylinder of the engine and an annular insulating member is mounted between the cylinder and the crankcase. The annular insulating member is made of a firm temperature-resistant plastic thereby protecting the crankcase from the temperature developed in the cylinder during the operation of the engine.

15 Claims, 6 Drawing Figures

CRANKCASE ASSEMBLY FOR AN ENGINE OF A PORTABLE TOOL

FIELD OF THE INVENTION

The invention relates to a crankcase assembly for an engine of a portable tool such as a chain saw having a motor assembly which includes a cylinder, piston, a connecting rod and a crankshaft. The crankshaft is rotatably journalled in a crankcase made of plastic.

BACKGROUND OF THE INVENTION

A portable tool of this kind is disclosed in published German patent application Ser. No. DE-OS 32 22 457 wherein a plastic crankcase containing the crankshaft bearing means is attached to the cylinder by means of threaded fasteners which pass through the crankcase from below. With this configuration, a substantial portion of the reaction forces occurring in the region of the crankshaft are directed to the crankcase during the operation of the motor. In order to resist the stress occurring thereby, the crankcase must be produced from a high quality plastic material since the operational reliability of the tool is otherwise adversely affected.

SUMMARY OF THE INVENTION

It is an object of the invention to provide a crankcase assembly for a portable tool which includes an inexpensive lightweight crankcase made of plastic and which is very substantially protected against strains induced by temperature.

The above object is realized with the crankcase assembly of the invention which is for an engine of a portable tool such as a chain saw or the like. The engine includes a cylinder, a piston arranged for movement in the cylinder, a crankshaft and a connecting rod interconnecting the piston and the crankshaft. The crankcase assembly includes a plastic crankcase for enclosing the crankshaft; bearing means for rotatably journalling the crankshaft in the crankcase; and, fastening means for fastening the crankcase to the cylinder, the fastening means including an annular insulating member interposed between the crankcase and the cylinder.

Preferred embodiments of the invention as well as the advantages and essential details thereof are disclosed in the drawing and in the description and the claims which follow.

BRIEF DESCRIPTION OF THE DRAWING

The invention will now be described with reference to the drawing wherein.

DESCRIPTION OF THE PREFERRED EMBODIMENTS OF THE INVENTION

Figure 1:
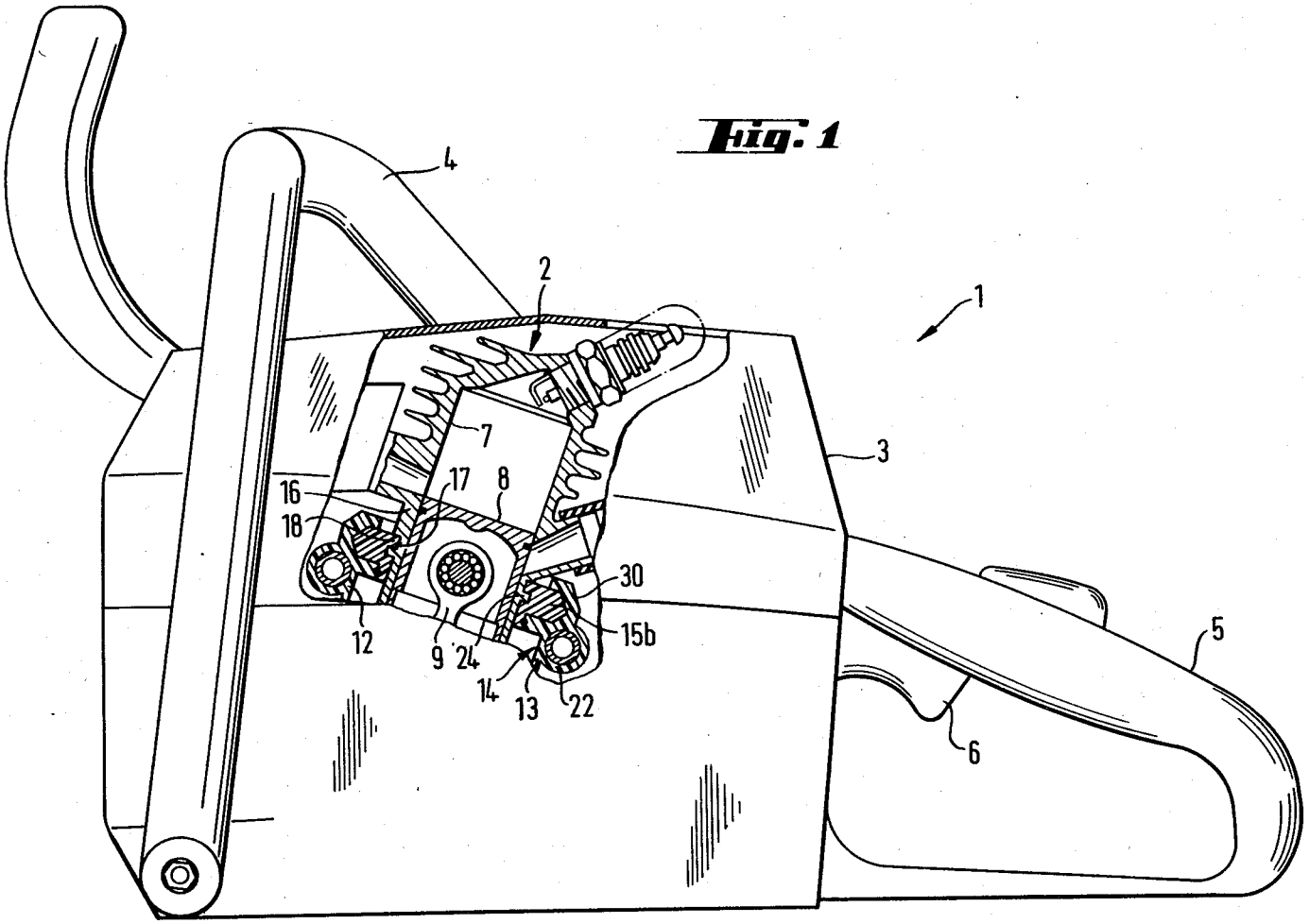
FIG. 1 is a side elevation view of the power head of a chain saw with a portion of the housing broken away to show the crankcase assembly according to the invention in section.

The portable tool shown in FIG. 1 is preferably configured as a chain saw or a hedge trimmer and includes an internal combustion engine 2 mounted in a housing 3. The tool includes a bale handle 4 and a rearward handle 5 in which the gas lever 6 for the internal combustion engine 2 is mounted.

The engine 2 includes a cylinder 7 wherein a piston 8 is journalled for reciprocatory movement. The piston 8 is connected to a crankshaft 10 by means of a connecting rod 9.

The crankshaft 10 is rotatably journalled in two crankshaft bearings 11 which are mounted in respective shells 12 and 13 of the crankcase. The two shells 12 and 13 are tightly joined to each other and conjointly define the plastic crankcase 14 which shields the crankcase region beneath the cylinder 7 with respect to the outside. It is not necessary that the crankshaft bearings 11 be held in the housing shells 12 and 13; instead, they could be releasably connected directly to cylinder 7 by bearing attachment means not shown so that the plastic crankcase 14 is very substantially relieved from the reaction forces occurring in the region of the crankshaft during the operation of the engine 2.

The two housing shells 12 and 13 mutually abut tightly against each other in a partition plane which extends perpendicularly to the crankshaft 10. The housing shells 12 and 13 are advantageously made of a very inexpensive plastic which does not have to exhibit any special or exceptional characteristics with respect to strength and long term resistance to temperature. The plastic crankcase 14 can therefore be made very simply and at low cost since it can be attached to the lower portion 16 of the cylinder 7 by means of an insulating ring 15. The attachment by means of the insulating ring 15 is preferably achieved by providing a form-tight attachment of the insulating ring on the cylinder 7 as well as a form-tight attachment of the upper portion 22 on the insulating ring 15 so that the reaction forces in the region of the crankshaft can be safely taken up and directed further.

Likewise, a spaced mounting for the plastic crankcase 14 is achieved by means of the insulating ring 15 which is preferably made of a firm high-temperature resistant plastic. A heat transfer from cylinder 7 to the plastic crankcase 14 is thereby substantially prevented and reduced to a minimum. The plastic crankcase 14 is therefore substantially shielded against temperature strains introduced by the engine 2 so that it can be made of a relatively inexpensive plastic material.

The insulating ring 15 itself can be made of several parts to facilitate production and assembly. Preferably, the insulating ring 15 is made up of two parts. Further, it can be advantageous to mold the insulating ring 15 directly on the cylinder 7 or to form the insulating ring 15 by spraying.

The cylinder 7 is provided with a peripheral groove 17 at the outside of its lower portion 16. The insulating ring 15 has a projection 18 which engages the groove 17. The peripheral groove 17 includes an inwardly directed diagonal surface 19 against which the projection 18 of the insulating ring 15 tightly lies with a correspondingly formed inclined surface 20 in order to provide a firm support.

Figure 2:
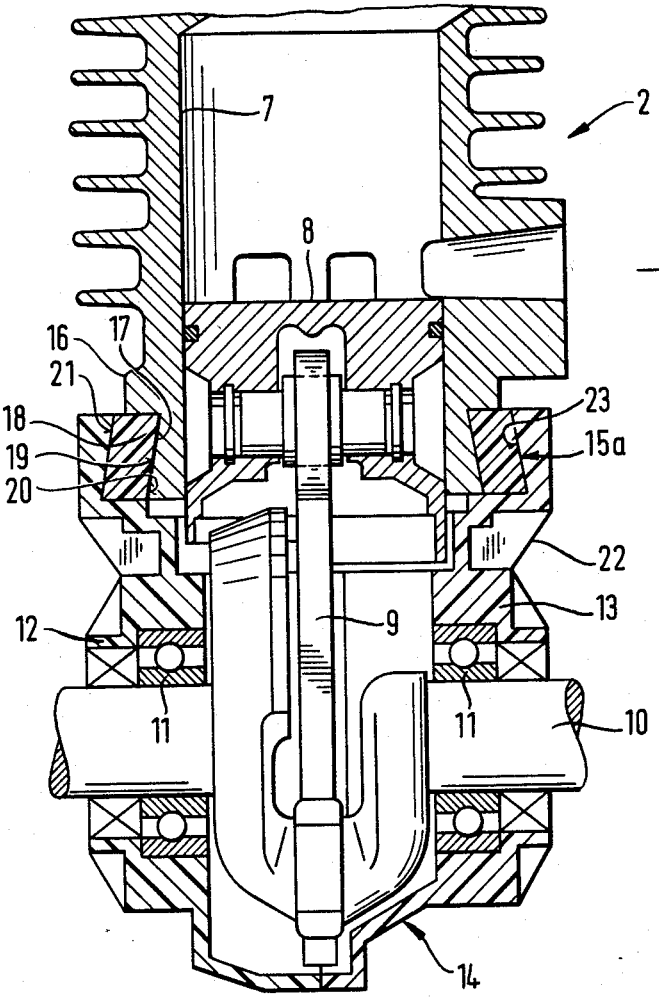
FIG. 2 is an elevation view, partially in section, taken through the engine and crankcase showing how the crankcase is secured to the cylinder of the engine according to one embodiment of the invention.

In the embodiment according to FIG. 2, the insulating ring 15*a* is configured in the form of a section of a hollow cone and has an outer conical surface 21 extending parallel to the inner inclined surface 20. The slanted course of the inclined surface 20 and the conical surface 21 is such that the diameter of the insulating ring 15*a* is smaller in the upper region than the lower region facing toward the crankshaft 10. The plastic crankcase 14 has an inclined wall 23 at its upper portion 22 which tightly surrounds the insulating ring 15*a* and lies tightly on the conical surface 21 so that an absolute position-certain and form-fit engagement is provided for a trouble-free transfer of the reaction forces during the operation of the engine 2. The insulating ring 15*a* of the instant embodiment is in the form of an annular conical frustum and is preferably tightly pressed into position during the manufacture of the cylinder 7.

Figure 3:
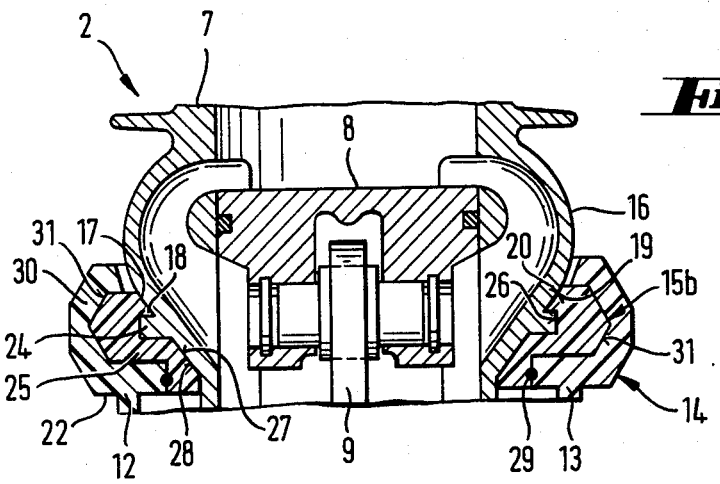
FIG. 3 is a view of the upper region of the crankcase and the lower portion of the cylinder and shows how the crankcase is secured to the cylinder according to another embodiment of the invention.

In FIG. 3, the insulating ring 15*b* is configured in a manner similar to the insulating ring 15*b* of FIG. 1. A radially outwardly extending projection 24 is provided at the lower portion 16 of the cylinder 7 and bounds the peripheral groove 17 at the lower end thereof. The projection 18 of insulating ring 15*b* is located in the peripheral groove 17 and overlaps the projection 24. In the downward direction, the insulating ring 15*b* has a supporting wall 25 which overlappingly engages the projection 24 from below. The supporting wall 25 also borders on an annular slot 26 formed in the inner wall of the insulating ring 15*b*. The transverse projection 24 is in form-tight engagement with the annular slot 26. The supporting wall 25 of the ring 15*b* has a supporting inclined surface 27 having the same inclination as the inclined surface 20 and lies tightly against an inclined outer surface 28 of the cylinder 7. This insulating ring 15*b* too can be advantageously formed or sprayed onto the cylinder 7 when the latter is produced. However, it is also within the scope of the invention to subsequently attach the insulating ring 15*b* at the lower portion 16 of cylinder 7.

FIG. 3 shows that a sealing ring 29 is mounted on a collar formed on the lower part of the supporting wall 25 so that a good seal is provided between the upper part 22 of the plastic crankcase 14 and the insulating ring 15*b*. The sealing ring 29 is preferably fixed in a peripheral groove as shown. The upper part 22 of the plastic crankcase 14 has an annular wall 30 in this region which is configured so as to have a C-shape when viewed in cross section. The annular wall 30 grasps the insulating ring 15*d* in a claw-like form-tight manner. For this purpose, the annular wall 30 includes inclined inner surfaces having an angular configuration which lie against the outer surfaces 31 of the insulating ring 15*b* which are angularly disposed with respect to each other.

Figure 4:
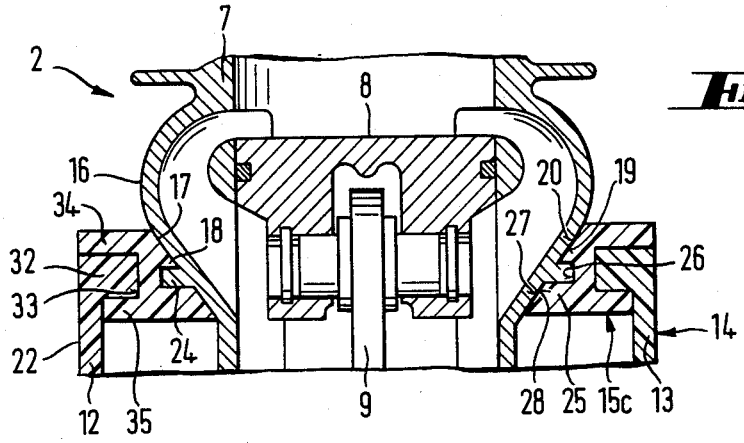
FIG. 4 is a section view showing the interface region of the crankcase and cylinder and illustrates how the crankcase is attached to the cylinder according to still another embodiment of the invention.

Referring now to the embodiment of FIG. 4, the upper portion 22 of the plastic crankcase 14 has a rim 32 formed thereon which is directed inwardly at a right angle with respect to the upper portion 22. A peripheral groove 33 is formed in the outer wall of the insulating ring 15*c* and is engaged by rim 32 in a form-tight manner. The rim 32 is substantially in the same plane as the projection 24 on the lower portion 16 of the cylinder 7. The upper leg 34 of the insulating ring 15*c* defines a portion of the peripheral groove 33. The upper leg 34 overlaps the rim 32 up to the outer surface of the plastic crankcase 14 and is configured so as to be longer than the lower leg 35 of the insulating ring 15*c* which overlaps the rim 32 at the lower side thereof.

Figure 5:
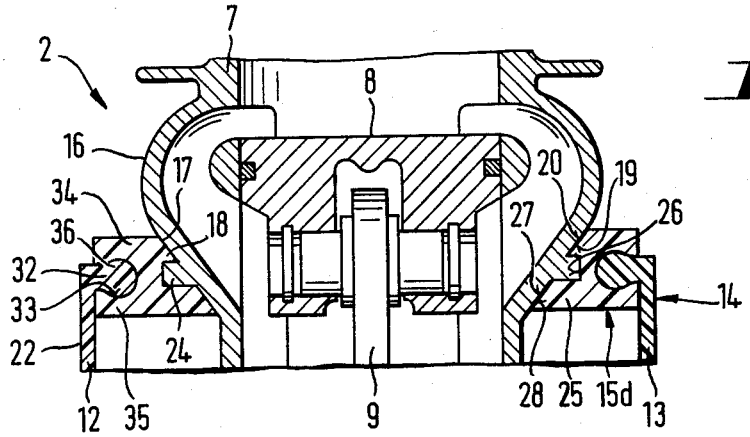
FIG. 5 is a section view showing still another arrangement for securing the crankcase to the cylinder according to a further embodiment of the invention; and, FIG. 6 is a section view similar to the one in FIGS. 3 to 5 and shows how the crankcase is attached to the cylinder according to still a further embodiment of the invention.

In the embodiment of FIG. 5, the insulating ring 15*d* is configured in a manner similar to the insulating ring 15*c* where there is likewise a rim 32 of the plastic crankcase 14 in form-tight engagement with a peripheral groove 33 of the insulating ring 15*d*. The form-tight engagement is in this embodiment configured so as to be even more intensive since a latching or clip-type mounting is provided for which the rim 32 has a bulbous portion formed thereon which engages an undercut opening formed in the base of the peripheral groove 33 so that an absolutely secure hold is provided.

Figure 6:
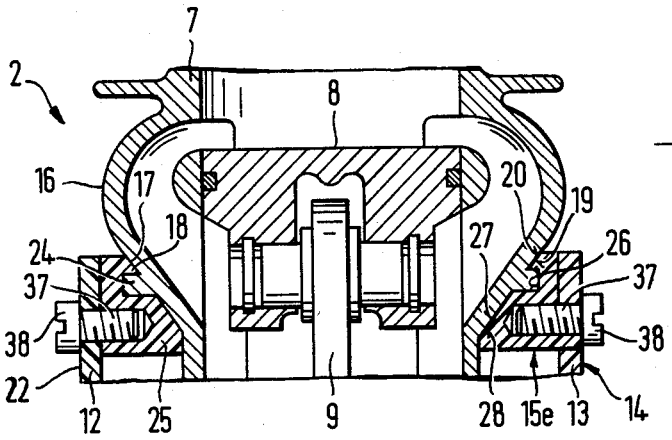

In the embodiment of FIG. 6, tapped blind bores are formed in the outer periphery of the insulating ring 15*e*. The plastic crankcase 14 has an upper portion 22 which surrounds the insulating ring 15*e* and has through bores for accommodating respective threaded fasteners 37 which pass through the wall of the upper portion 22 of the plastic housing 14 and threadably engage corresponding ones of the threaded blind bores of insulating ring 15*e*. The head 38 of threaded fastener 37 presses the upper portion 22 of the plastic housing 14 tightly against the insulating ring 15*e* from the outside.

It is understood that the foregoing description is that of the preferred embodiments of the invention and that various changes and modifications may be made thereto without departing from the spirit and scope of the invention as defined in the appended claims.

What is claimed is:

1. A crankcase assembly for an engine of a portable tool such as a chain saw or the like, the engine including a cylinder, a piston arranged for movement in the cylinder, a crankshaft and a connecting rod interconnecting the piston and the crankshaft, the crankcase assembly comprising:

a plastic crankcase for enclosing the crankshaft;

bearing means for rotatably journalling said crankshaft in said crankcase; and, fastening means for fastening said crankcase to said cylinder, said fastening means including an annular insulating member interposed between said crankcase and said cylinder.

2. The crankcase assembly of claim 1, said cylinder having a lower end portion facing toward said crankshaft, said annular insulating member being seated form-tight on said lower end portion, said crankcase having an upper end portion seated form-tight on said annular insulating member.

3. The crankcase assembly of claim 2, said annular insulating member being made of a firm temperature-resistant plastic thereby protecting said crankcase from the temperature developed in said cylinder during the operation of the engine.

4. The crankcase assembly of claim 3, said lower end portion having a peripheral groove formed therein; and, said annular insulating member having a projection formed thereon and adapted for seating in said groove thereby mounting said insulating member onto said cylinder.

5. The crankcase assembly of claim 4, said groove being conjointly defined by two wall surfaces, one of said wall surfaces being an inclined surface; and, said projection having an inclined surface formed thereon for being in contact engagement with said inclined surface of said groove.

6. The crankcase assembly of claim 5, said annular insulating member being a conical frustum having an outer inclined surface parallel to said inclined surface formed on said projection, said upper end portion of said crankcase having an inclined wall portion formed thereon for gripping and overlapping said outer inclined surface of said annular insulating member.

7. The crankcase assembly of claim 3, said lower end portion of said cylinder having an inclined surface formed thereon and having a transverse projection also formed thereon which bounds on the lower end of said inclined surface so as to conjointly define a peripheral groove therewith on said cylinder; and, said annular insulating member having a peripheral projection formed thereon for gripping and overlapping said transverse projection from above.

8. The crankcase assembly of claim 7, said annular insulating member further including a supporting wall formed thereon for gripping and overlapping said transverse projection from below, said peripheral projection and said supporting wall conjointly defining an annular slot for accommodating said transverse projection therein.

9. The crankcase assembly of claim 8, said lower end portion of said cylinder having a further inclined surface disposed beneath said transverse projection, said supporting wall having an inclined supporting surface in contact engagement with the further inclined surface.

10. The crankcase assembly of claim 2, comprising a sealing ring disposed between said upper end portion of said crankcase and said annular insulating member.

11. The crankcase assembly of claim 2, said upper end portion of said crankcase having a C-shaped cross section for gripping and overlapping said annular insulating member.

12. The crankcase assembly of claim 2, said upper end portion of said crankcase having an inwardly directed rim formed thereon; and, said annular insulating member having a peripheral groove formed in the outer surface thereof for accommodating said rim therein.

13. The crankcase assembly of claim 12, said rim having a bulbous protuberance formed on the end thereof; and, said peripheral groove being undercut so as to receive said protuberance in latching engagement therewith.

14. The crankcase assembly of claim 2, comprising threaded fastener means for threadably fastening said upper end portion of said crankcase to said annular insulating member.

15. a power head for a portable tool such as a chain saw, hedge trimmer or the like, the power head comprising:

a housing; and, an engine mounted in the housing and including:

a cylinder;

a crankshaft;

a connecting rod interconnecting the pistion and the crankshaft;

a plastic crankcase for enclosing the crankshaft;

bearing means for rotatably journalling said crankshaft in said crankcase; and, fastening means for fastening said crankcase to said cylinder, said fastening means including an annular insulating member interposed between said crankcase and said cylinder, said annular insulating member being made of a firm temperature-resistant plastic thereby protecting said crankcase from the temperature developed in said cylinder during the operation of the engine.

* * * * *

UNITED STATES PATENT AND TRADEMARK OFFICE

CERTIFICATE OF CORRECTION

PATENT NO. : 4,610,228

DATED : September 9, 1986

INVENTOR(S) : Reinhold Fink and Michael Leuchte

It is certified that error appears in the above-identified patent and that said Letters Patent is hereby corrected as shown below:

In column 6, line 17: delete "a power head" and substitute -- A power head -- therefor.

In column 6, line 24: delete "pistion" and substitute -- piston -- therefor.

Signed and Sealed this

Ninth Day of December, 1986

*Attest:*

DONALD J. QUIGG

*Attesting Officer*

*Commissioner of Patents and Trademarks*